US006858064B2

(12) United States Patent
Bologa et al.

(10) Patent No.: US 6,858,064 B2
(45) Date of Patent: Feb. 22, 2005

(54) APPARATUS FOR THE ELECTROSTATIC CLEANING OF GASES AND METHOD FOR THE OPERATION THEREOF

(75) Inventors: Andrei Bologa, Karlsruhe (DE); Thomas Wäscher, Heidleberg (DE); Hans-Rudolf Paur, Karlsruhe (DE); Werner Baumann, Karlsruhe (DE)

(73) Assignee: Forschungszentrum Karlsruhe GmbH, Karlsruhe (DE)

( * ) Notice: Subject to any disclaimer, the term of this patent is extended or adjusted under 35 U.S.C. 154(b) by 0 days.

(21) Appl. No.: 10/751,239

(22) Filed: Jan. 2, 2004

(65) Prior Publication Data

US 2004/0139853 A1 Jul. 22, 2004

Related U.S. Application Data

(63) Continuation-in-part of application No. PCT/EP02/06873, filed on Jun. 21, 2002.

(30) Foreign Application Priority Data

Jul. 10, 2001 (DE) ..... 101 32 582

(51) Int. Cl.[7] ..... B03C 3/014

(52) U.S. Cl. ..... 95/65; 55/DIG. 38; 95/66; 95/71; 95/75; 95/78; 96/44; 96/49; 96/50; 96/55; 96/61; 96/74; 96/97

(58) Field of Search ..... 95/64–71, 75, 95/78; 55/DIG. 38; 96/44–50, 55, 61, 70, 74, 97

(56) References Cited

U.S. PATENT DOCUMENTS

| | | | | | |
|---|---|---|---|---|---|
| 2,864,458 | A | * | 12/1958 | De Graaf et al. | 96/27 |
| 2,983,332 | A | | 5/1961 | Vicard | 95/60 |
| 3,395,193 | A | * | 7/1968 | Bruce et al. | 585/539 |
| 3,999,964 | A | * | 12/1976 | Carr | 96/59 |
| 4,029,482 | A | * | 6/1977 | Postma et al. | 95/58 |
| 4,222,748 | A | | 9/1980 | Argo et al. | 95/64 |
| 4,449,159 | A | | 5/1984 | Schwab et al. | 96/62 |
| 6,110,256 | A | * | 8/2000 | Reynolds et al. | 95/4 |
| 6,294,003 | B1 | * | 9/2001 | Ray | 96/49 |
| 6,579,349 | B1 | * | 6/2003 | Ting et al. | 96/44 |

FOREIGN PATENT DOCUMENTS

| | | | | |
|---|---|---|---|---|
| DE | 2235531 | * | 2/1973 | |
| FR | 1 250 161 | | 2/1960 | |
| FR | 2483259 | * | 12/1981 | |
| JP | 52-40881 | * | 3/1977 | 96/49 |

* cited by examiner

*Primary Examiner*—Richard L. Chiesa
(74) *Attorney, Agent, or Firm*—Klaus J. Bach

(57) ABSTRACT

In an apparatus for the purification of a gas which apparatus includes a three section conduit with an ionization and cleaning section in which particles contained in water-saturated air are ionized and then conducted through a chamber with grounded walls so that part of the particles are deposited on these walls, an additional cleaning section which includes grounded tubes past which the gas is conducted to remove additional charged particles and a filter section in which dry remaining fine particles are removed from the gas stream, the deposited particles are flushed from all three sections and the flushing water including the particles is cleaned and recycled.

15 Claims, 7 Drawing Sheets

225
L
210
211
Arrangement 1
212
223
224
D2

220
221
213
225
216
217
222
213
214
215
231
232
212
Arrangement 2

APPARATUS FOR THE ELECTROSTATIC CLEANING OF GASES AND METHOD FOR THE OPERATION THEREOF

This is a Continuation-In-Part application of international application PCT/EP02/06873 filed Jun. 21, 2002 and claiming the priority of German application 10/325582.7 filed Jul. 10, 2001.

BACKGROUND OF THE INVENTION

The invention resides in a method and an apparatus for cleaning industrial gases by the removal of solid and liquid particles as they or contained for example in the gases generated by municipal waste combustion in the metallurgical, chemical and other industrial plants.

The filtering of gases containing mainly submicron-particles is an urgent practical problem. The effectiveness of presently available gas purification equipment is not satisfactory.

If possible at all, purification of gases including submicron particles requires high gas speeds. Often cyclones are used herefor, wherein the gas flow is rotated utilizing the centrifugal forces for the particle separation. This however consumes a relatively large amount of energy. In electrostatic separators, on the other hand, the number of electric fields or the length of the high voltage electrodes or of the grounded electrodes must be increased. Again, this increases the energy consumption for the electrostatic charging of the particle and also the size of the gas purification plant. In wet separators, the collection of the submicron particles substantially increases the need for the spray liquid and also requires a high relative speed between the water droplets and the gas flow.

For the collection of the submicron particles, different microporous filters are used such as ceramic filters, filter sacks and bags etc. (see U.S. Pat. No. 4,029,482, U.S. Pat. No. 3,999,964).

The effectiveness of most of these devices however is limited by the low velocity of the gas flow. In many devices, the collection of submicron particles also causes a high-pressure loss, which results in high-energy consumption. Also, the filters need to be cleaned frequently by pneumatic pulses or washing.

The collection of submicron particles can be improved by saturating the gas with water vapors. The water vapor condensation on particles, the particle charge in an electric field and their discharge by the gas flow is described for example in U.S. Pat. No. 4,222,748 or FR 2,483,259 or DE 2,235,531 or CA 2,001,990.

The known technical solutions have several disadvantages: For the electrical charging of the particles, long arrangements of electrodes are needed for a corona discharge in the space between the electrodes. These electrode systems require high voltages and generate an electric field with a non-homogeneous distribution in the charging zone. This does not provide for an effective electric charging of the particles in the gas at all locations in the space between the electrodes.

Ionization devices are also used for electrically charging particles. However, this requires several ionization devices, which renders the gas purification plant relatively complex. The high voltage ionization devices require large amounts of compressed air and therefore increase the energy consumption.

Filters or absorbers washed by water require large amounts of water for spraying and increase the pressure losses in the gas purification plant.

It is the object of the present invention to provide a gas purification apparatus wherein gases can be purified with improved efficiency.

SUMMARY OF THE INVENTION

In an apparatus for the purification of a gas which apparatus comprises three-conduit sections, that is, 1. a ionization and cleaning section in which the particles contained in water-saturated air are ionized and then conducted through a chamber with grounded walls so that part of the particles are deposited on these walls,
2. an additional cleaning section which includes grounded tubes past which the gas is conducted to remove additional charged particles and,
3. a filter section in which dry remaining fine particles are removed from the gas stream, the deposited particles are flushed from all three sections and the flushing water is cleaned and re-cycled.

The sections are formed by three coherent assemblies, which are installed into the gas conduit at technically suitable locations, that is, in the flow direction of the gases:

A first location in a first conduit section 1, in which the electrostatic charging unit or group of units for generating a corona discharge is or are arranged so that in the subsequent space, a space charging area is formed, out of which essentially the equally charged particles are directed toward the inner wall of the tube section 1 by thermal movement and charge repulsion where they are neutralized, A second location in a second conduit section 2 in which the charged particles still present in the gas from the space charging area are removed in a group of grounded electrodes and the particles deposited are electrically discharged, and finally a third location in a third conduit section 3, in which the filter device is installed and wherein rest particles remaining in the gas are removed from the gas which is then discharged to the environment.

The electrostatic charging unit installed in the first conduit section 1 is constructed in the flow direction as follows:

Around the circumference along the inner wall of the gas conduit, there is first a collector 110 for the collection of the water condensed on the inner wall of the gas conduit. Then follows the grounded electrode plate 11, which extends over the open cross-section of the conduit in the form of a plate which, evenly distributed over the cross-section, includes parallel perforations or nozzles extending parallel to the axis of the gas conduit. Each nozzle is in the form of a Laval nozzle, which, over the thickness of the plate, first becomes conically narrower up to a narrowed-down center area and then becomes again uniformly larger in the form of a cone. Extending over the open cross-section of the gas conduit a high voltage electrode grid 112 is disposed adjacent the grounded electrode. The high voltage electrode grid is provided with the electrodes 113, which extend therefore in a direction opposite to the direction of the gas flow and are all provided with a pointed end extending into one of the nozzles of the electrode plate. The electrodes can each be adjusted axially that is parallel to the axis of the respective conduit section and also laterally and axially together with the grid 112. The high voltage grid 112 is held in position by at least one adjustable penetration.

A second conduit section 2 includes a group of grounded electrodes 212 of the following design:

The group of grounded electrodes comprises a bundle of tubes whose longitudinal axes extend parallel to the axis of the conduit section 2 and fill this section. They consist of a gas-inert material, which may be electrically conductive or non-conductive. The tubes do not contact one another. They are held in spaced relationship by perforated plates disposed at the opposite front ends of the tubes. This bundle of tubes is surrounded directly by the conduit section 2. The openings in the perforated front plates coincide with the tube openings of the tube bundle. The openings in the front plates have the same diameter as the tubes. An intermediate plate has the same arrangement of openings but the openings have a diameter corresponding to the outer diameter of the tubes. In addition, the intermediate plate or plates have, at their circumferential edges an area where they do not abut the inside of the conduit section so that, in this way, a passage through the chamber system is formed. The two axially outer chambers are each provided with a pipe connector installed in the wall of the conduit section for connection to a cooling system. In this way, the tube bundle can be cooled without the coolant coming in contact with the gas which is still loaded with particles.

The tube bundle 212 is supported with its downstream edge, on an electrically conductive support grid 211, which is mounted in an electrically conductive manner to the wall of the conduit section 2 by an annular bracket 210.

A spray water supply pipe extends from the conduit wall 2 to the center of the conduit at the upstream end of the tube bundle 212. It is provided at its end with a spray head 220 having a spray axis coinciding with the axis of the conduit 2 and being disposed at a distance from the grounded electrodes 212. The spray cone of the spray head 220 extends over the cross-section of the conduit so that, with a periodic spraying, the exposed front side of the electrode or tube bundle 212 a is completely covered by the water spray. With this spray water, the inner wall surfaces of the tubes 212 are flushed, deposited particles are washed out and, because of the humidity/moisture and the associated usable electric conductivity, the particles are neutralized and discharged partially through the discharge connector 232.

In the third conduit section 3, which follows downstream, a unit for filtering the gas is installed. It includes a pipe, which extends from the wall of the conduit section 3 to its axis and is then angled downwardly in flow direction leading along the axis of the conduit section 3 into a chamber surrounded cylindrically by filters. This axial pipe section extends through a cover 311, which is disposed at the gas inlet side of the filter and prevents that the gas enters the interior of the filter without passing through the filter. At the end of the pipe, there is at least one spray head 322 for wetting the whole inner wall of the filter arrangement.

The filter cover 311, 312 comprises two concentric parts which, when assembled form an annular tub 324 whose annular opening faces the oncoming gas flow. In this tub water deposited in the upstream conduit section 2 is collected and discharged by way of a connector 319.

The filter arrangement consists of a structure or cage 323, which is surrounded by a porous material 310 comprising one layer and forming the actual filter.

Between the inner wall of the conduit section 3 and the outer wall of the filter arrangement, there is an annular space, into which the gas containing still remaining particles, flows. The filter arrangement is supported with its downstream end face on an annular console 314, which is mounted to the wall of the conduit section 3 and which forms, with the wall of the conduit section 3, an annular tub for collecting part of the spray water 320, which is then discharged by way of the connector 317 extending through the wall of the conduit section 3. As a result, the gas including the remaining particles must flow through the filter, which is held between the downstream console 314 and an upstream console 313. The gas, which was forced through the filter and thereby cleaned from particles, passes as purified gas through the annular console into the downstream area.

The second conduit section may be different in that the bundle of grounded electrodes 212 of an electrically conductive or non-conductive material comprises parallel tubes 212, which are not arranged in a particular order and which may be in contact with one another. The bundle of tubes is supported by a grounded support grid 211 and is locked there in position. The individual tube walls are exposed to the flowing gas at both sides, that is, the gas still to be cleaned flows over the inside and the outside walls of the tubes. As a result, the particle deposit and neutralization area is substantially increased up to two times if the tubes are not in contact with one another. No coolant flows through the space between the tubes 212 since no separate chambers are provided; no cooling takes place therefore. On the other hand, the tubes are not subjected to different mechanical stresses on the inside and outside walls so that they may be extremely thin. It is sufficient if the wall thickness $d_{WS}$ of a tube 212 with respect to its diameter D2 is in the range of $0.01<D_2<0.11$.

In a particular embodiment, the high voltage grid 112 is connected to a high-voltage source by way of a penetration 117 or by several penetrations, which are evenly distributed over the circumference of the conduit section. A blockage gas 116 may be admitted through one or all of the penetrations for maintaining good insulation.

The surface areas of the tubes 212 of the bundle of grounded electrodes 212 may be enlarged inside and/or outside in order to improve the heat transfer and also to provide a large particle deposition area.

For an effective removal of contamination carried along with the gas flow each of the tubes may include a spiral structure which induces a spiral movement of the gas through the tubes thereby generating centrifugal forces.

The wastewater is removed at the bottom of the grounded electrodes from the circumferential area thereof and is supplied to a purification unit together with the water collected on the filter cover and on the annular console at the bottom of the filter.

The purification process is performed as follows:

Before the introduction of the gas into the apparatus, the gas is cooled and saturated with water vapor.

The gas flow 4 is conducted past a condensate collector 110 through a plate 111, which is grounded and provided with nozzle passages including reduced diameter center sections with conically opening exit ends, into an intermediate space which is formed by the exit areas of the nozzles. Electrode tips 122 extend into the conical expansion area wherein the aerosol particles are electrostatically charged.

A part of the electrically charged aerosol particles of the gas stream are discharged as a result of a space discharge downstream by electrostatic repulsion between the electrically charged particles and the charged aerosol deposits on the inner walls of this area.

The gas stream is conducted through a system of hollow, grounded electrodes, wherein at the same time charged aerosols are deposited on the surfaces of the grounded electrodes which are contacted by the gas stream. Then the gas stream is forced into the annular area between a tubular filter structure and the wall of the gas conduit and through the filter of a porous material, As the gas passes through the filter, the charged particles are more or less completely deposited on the filter material—depending on the type of filter material. The gas cleaned in this way is then discharged downstream into the environment. The filter arrangement is continuously or periodically washed internally, by spraying water from the spray heads, whereby the particles deposited in the filter web are flushed out with the spray water.

Further useful method steps are:

Before the gas enters the bundle of grounded tubes, water is sprayed into the gas in a preceding chamber.

The gas stream through the bundle of tubes is cooled by coolant flowing through the spaces between the tubes. Furthermore, the charged particles, which are deposited on the respective inner tube walls, are discharged by a periodic wetting of the inside walls of the tube bundle from the end facing the gas flow. Since the gas stream through the grounded tubes receives a swirl by flowing through the spiral tube inserts the particles still in the gas stream are carried outwardly by centrifugal forces and therefore moved onto the inner walls of the tubes and, when deposited thereon, are electrically neutralized and flushed out.

The gas purification is very effective with relatively low pressure losses; there is only a small energy consumption for the electrostatic charging. No continuous water spray is necessary for the cleaning of the grounded electrodes, but continuous spraying is easily possible.

With the modular construction of the apparatus and the relatively small size thereof, the apparatus can be easily used for an expansion of existing gas purification plants and to expand the effectiveness of existing plants to remove also submicron particles. The components consist of lightweight materials, which are also corrosion resistant with regard to the gases to be cleaned.

The spray- and wastewater is purified and re-cycled so that no wastewater is discharged into the municipal canalization except possibly for a very small amount.

The grounded electrode/plate with the nozzles, which are uniformly distributed over the surface thereof and which have a Laval configuration with widening gas outlets has the effect of accelerating the saturated gas. As a result the gas is expanded and water vapors are condensed which increases the number of charged particles with lower movability. Then the zone of space charges with high charge volume density is reached whereby the discharge of particles by the additional gas flows at the grounded components of the apparatus is ensured.

In summary, the apparatus and the method of operation have the following advantages:

- the plant is of modular construction;
- the plant is relatively small and lightweight;
- the components consist of a material which is corrosion resistant with respect to the raw/uncleaned gas;
- submicron particles are effectively removed from the gas;
- the energy consumption for the electrostatic charging of the particles in the gas is low;
- the pressure loss in the apparatus is low;
- there is no need for cleaning the electrodes and the filter by a continuous water spray;
- the water discharged from the three conduit sections is purified and recycled so that there is hardly any waste water discharge.

Below. the apparatus according to the invention will be described on the basis of the accompanying drawings, wherein FIGS. 1–6 relate to preferred embodiments of the apparatus and FIG. 7 shows the particle concentration in the gas when entering and when leaving the apparatus.

DESCRIPTION OF PREFERRED EMBODIMENTS

Figure 1:
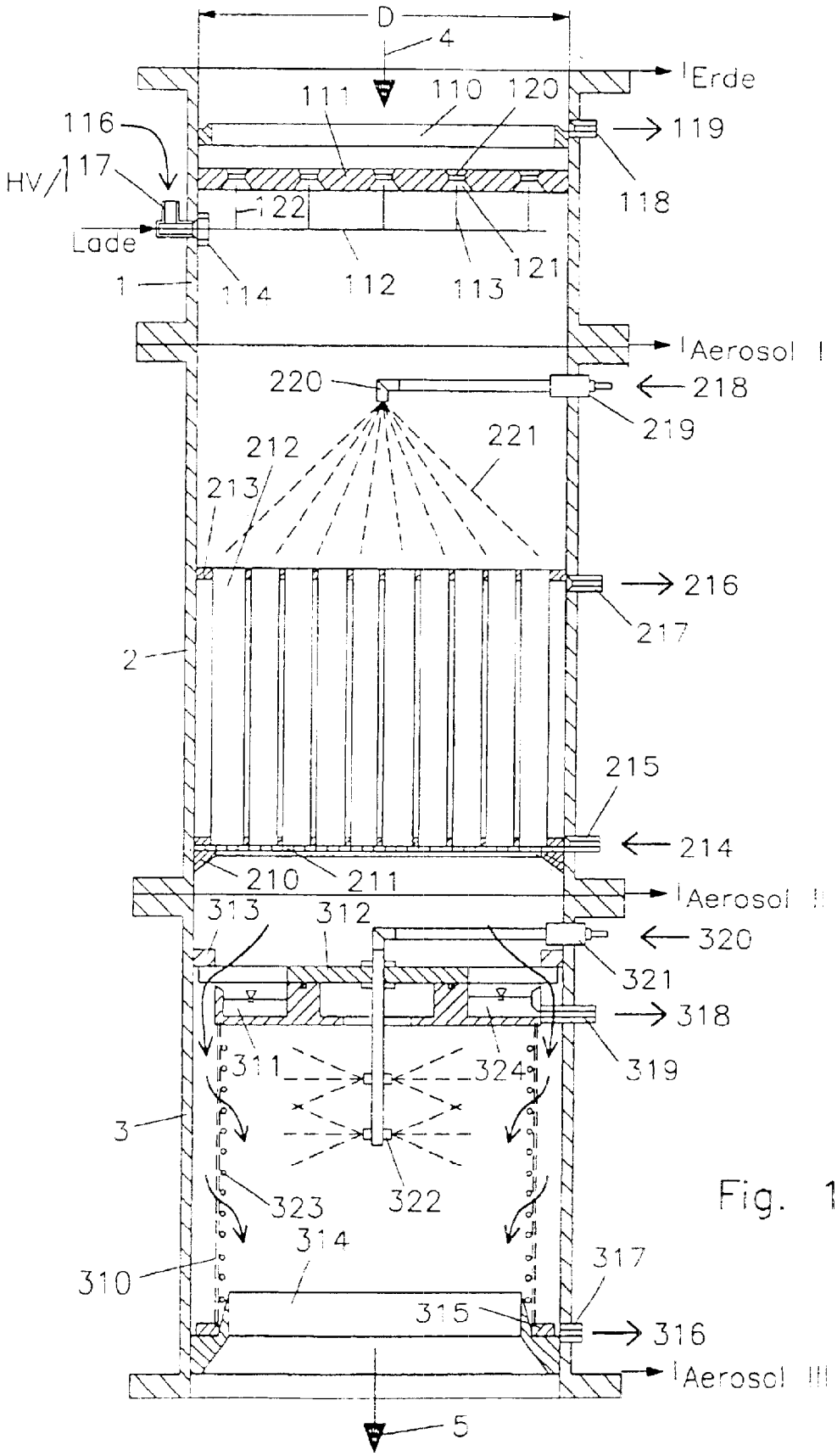
FIG. 1 is a sectional overall view of the apparatus according to the invention.

The front side of the tube bundle 212 facing the gas stream is disposed at a distance from the high voltage electrode 112 of the charging unit, which is 1.5 to 5 times the diameter D of the grounded electrode plate. D, that is the inner diameter of the gas conduit section 1 or, respectively, 2 or, respectively, 3 of the gas conduit including the gas to be cleaned, has a size in a range such that, with the raw gas volume flow divided by the area corresponding to D, a gas flow speed of 0.1 to 10 m/sec, preferably 0.5 to 2 m/sec, is obtained. This is known from the gas flow dynamics. The dimension are therefore determined in accordance with the gas volume and the flow speed. The length of the grounded electrodes 212, that is of the tubes 212, can be deduced from the main parameter D as follows:

$$0.5D<L<5D.$$

The apparatus for the electrostatic cleaning of gas comprises in accordance with the schematic representation of FIG. 1, the first conduit section 1 including the electrostatic charging unit, a second conduit section 2 with the group of grounded electrodes 212, which consist of a bundle of tubes and finally the third conduit section 3 including the filter structure. The gas flow is indicated at the inlet to the first conduit section 1 by the arrow 4 indicating the raw gas entering the apparatus and at the exit of the third conduit section 3 by the arrow 5 indicating the purified gas leaving the apparatus. The conduit sections 1 to 3 in the present case have for example a circular cross-section but the apparatus may also be constructed with a rectangular cross-section.

Upstream of the electrostatic charging unit 1 at the entrance to the apparatus the annular collector 110 is supported on the interior wall of the first conduit section 1 for collecting the condensed water flowing down the conduit wall in order to protect the charging unit 111 disposed just below. The collected condensed water is conducted out of the apparatus by way of the connector 118 for reconditioning.

The grounded electrode 111 of the charging unit 1 is a plate 111 extending over the whole width of the conduit section 1. It consists of an electrically conductive material, such as graphite or another corrosion-resistant metal such as stainless steel. The plate is provided with nozzles uniformly distributed over the cross-section of the conduit section 1. They have, in flow direction, the following configuration:

An entrance area, which becomes conically smaller and forms a compression zone, a reduced diameter center area and then an exit area 121, which widens conically. The three areas entrance area, reduced diameter center area and exit area are arranged directly adjacent one another. The entrance and exit areas have the same or a different length. In the case shown, the entrance area is shorter than the exit area. The number of nozzles and their diameters depend on the conditions of the technical process, on the volume of the gas to be purified, on the condition for the effective charging of the aerosol and the minimum pressure loss in the charging unit 1. Other types of nozzles may also be used if they are similarly efficient.

The high voltage grid 112 is disposed adjacent to, and downstream of, the grounded electrode 111 and extends over the whole cross-section of the conduit section 1. It is supported by the penetration 114 or by several penetrations 114, which are uniformly distributed over the circumference and by way of which the position of the grid 112 can be laterally adjusted within certain limits. One of the penetrations serves as high voltage connection between a power supply and the grid 112. To all penetrations 174, a blocking gas 116 is supplied by way of a connector 17 in order to provide at the penetrations, well-defined electrical conditions. The blocking gas 116 is generally temperature controlled, but this is not absolutely necessary for the design of the apparatus.

Figure 2:
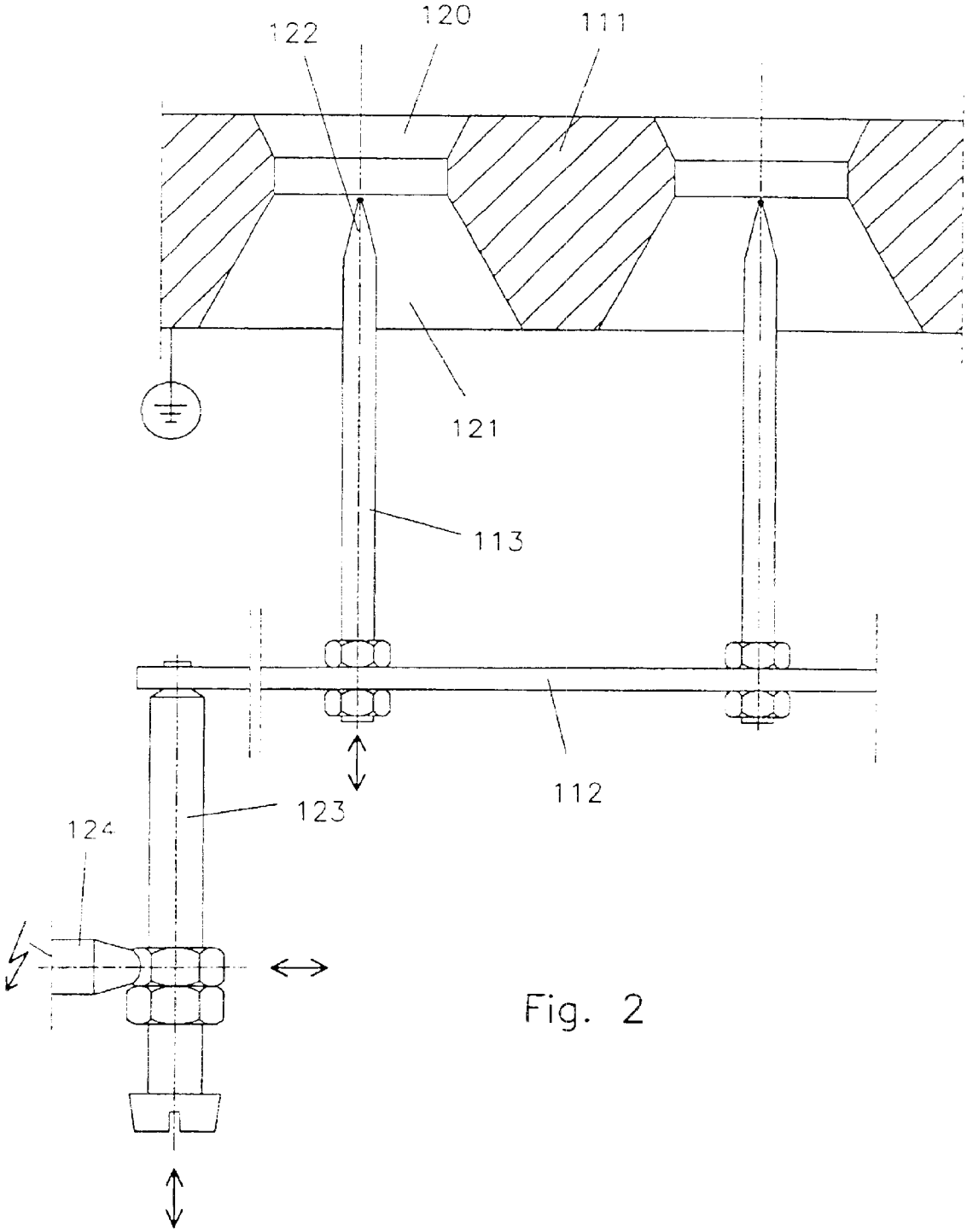
FIG. 2 shows a section of the conduit including a charging structure.
Figure 3:
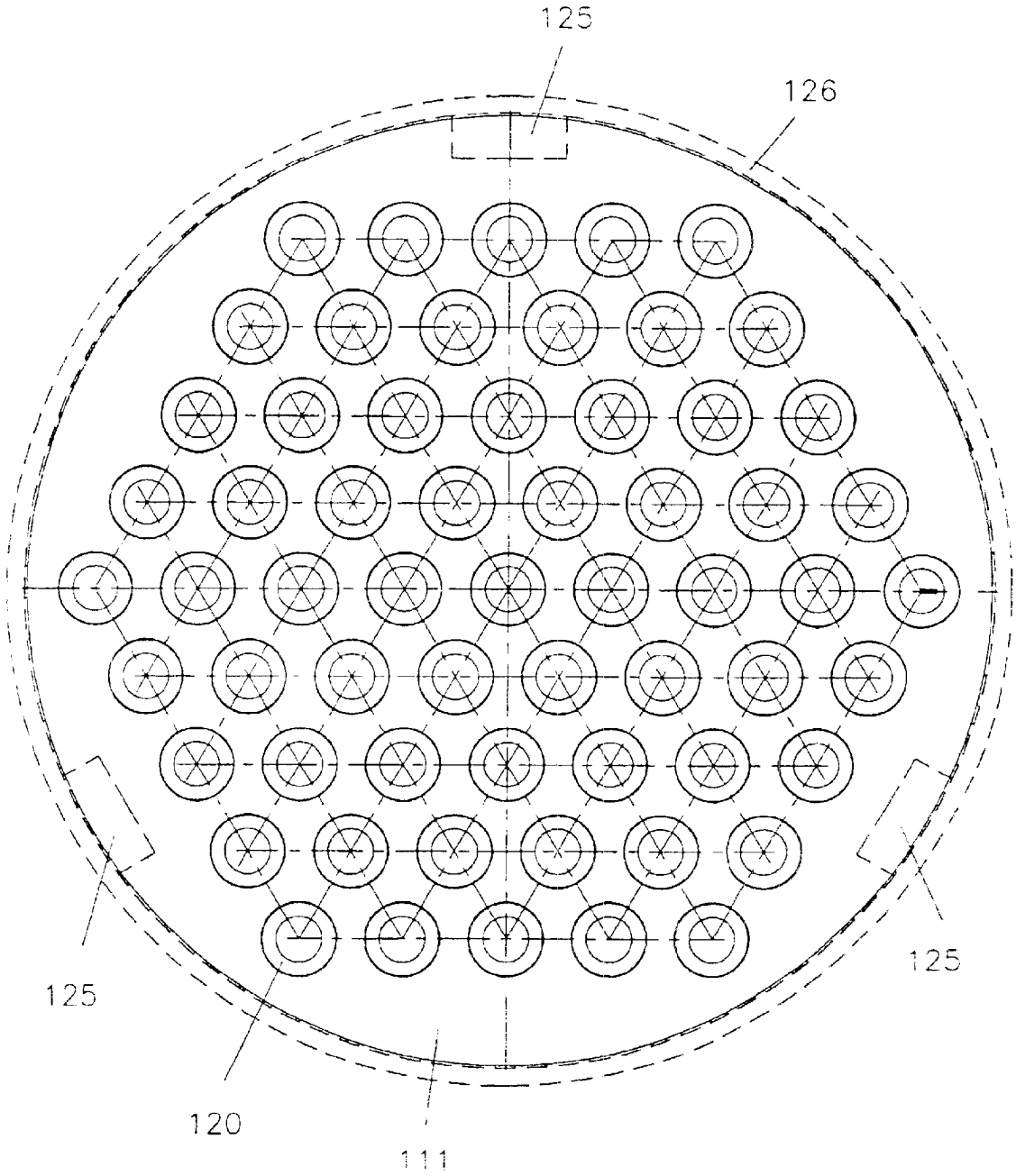
FIG. 3 shows a nozzle plate with nozzles extending therethrough and the charging structure.
Figure 4:
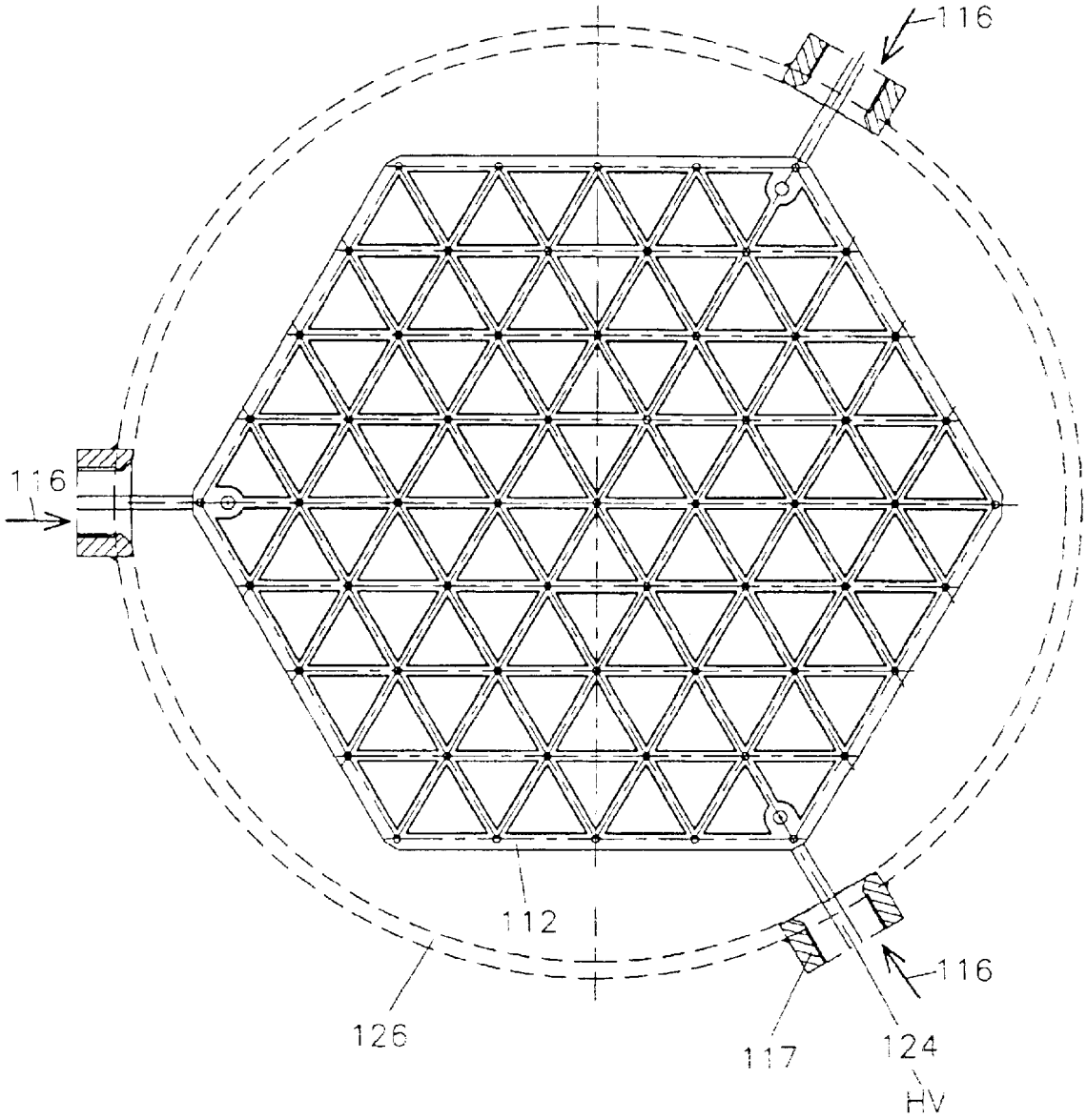
FIG. 4 shows the high voltage electrodes in the charging structure.

The mesh of the high voltage grid 112 is as wide as possible and has intersections in accordance with the arrangement of the nozzles in the grounded nozzle plate 111. In these intersections, the electrodes 113 are mounted so that they extend with their tips 122 toward the gas flow into the nozzle outlet openings 121. For each nozzle opening, an electrode 113 is provided on the high voltage grid 112. The electrode grid 112 together with the electrodes 113 mounted thereon is axially and laterally adjustable (see FIGS. 1 to 4). In this way, the level of the pre-discharge voltage and the current density in the area of the electrode gap where the charging of the particles occurs, can be adjusted. The maximum current density with a minimum high voltage applied depends on the position of the tips 122 of the electrodes 113 in the control outlet area 121 of the nozzles. The axial position of each nozzle tip 122 in the conical outlet 121 of the nozzle is individually adjustable (see FIG. 2). Downstream of the electrode grid 112, the conduit section 1 includes a space charge volume formed by the ionized particles/aerosols which extends from the high voltage grid 112 up to the second conduit section 2.

Figures 5A, 5B, 5C, 5D:
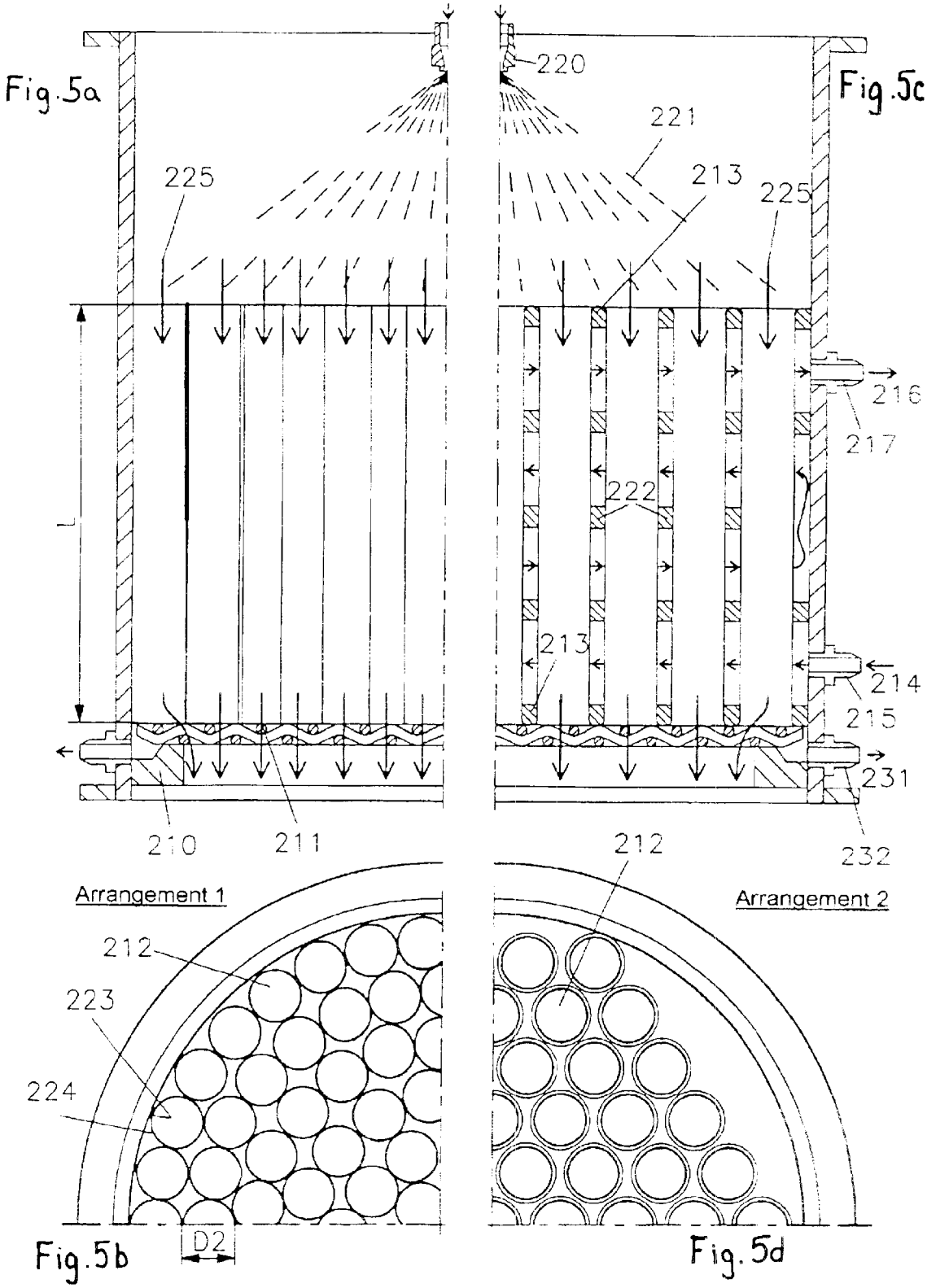
FIGS. 5*a* and 5*b* show one embodiment of the conduit with grounded hollow electrodes.
FIGS. 5*c* and 5*d* show another embodiment of the conduit with grounded hollow electrodes.

The conduit section 2 with the grounded electrodes 212 comprising a bundle of tubes (see FIG. 1 center and FIG. 5 arrangement 2) is spaced from the grid 112 by a distance of 1.5 to 5 D, wherein D is the inner diameter of the conduit sections 1, 2, and 3 in accordance with the characteristic dimension parameter of the grounded electrode 111 explained earlier. An example for the arrangement of the grounded tube bundle 212 is shown in FIGS. 5*b* and 5*d*. The inner diameter of the tubes 212 is so selected that a laminar gas flow in the tubes will not occur.

The tubes 212 as well as the walls of the conduit sections 1 to 3 may consist of a conductive material such as graphite, a stainless steel which is inert for the particular process, VA or a non-conductive material such as PP, PVC, PVDF, GFK. The materials may be rigid or flexible. The number and the diameter of the tube electrodes 212 depends on the conditions, which provide for effective deposition of the charged particles on the electrode walls 212 and minimal pressure losses in the tube arrangement.

The tube bundle 212 is engaged between two perforated plates 218 which have openings sized to accommodate the tubes 212 such that an open passage extends through each tube 212. In addition, the tube bundle 212 is supported by three additional perforated plates 222 whose openings correspond to the outer diameter of the tubes 212. These three plate 222 are arranged equidistantly between the two outer perforated plates 213 and are provided at one location of their circumference with a recess such that a chamber system is formed between the outer plates 213 through which a coolant can be conducted in a meander-type flow pattern. The two end chambers are provided each with a connector 215, 217 mounted in the wall of the conduit section 2 through which a coolant can be conducted past the tubes 212 for cooling the tubes which increases the gas purification efficiency. If, as coolant 214 a gas, for example air at ambient temperature, is used the heated discharge air 216 can be used as the isolation air/blocking gas.

The tube bundle 212 with the perforated plates 213 and 222 is supported at its downstream end on a support structure 211 which in the embodiment shown is a web structure of metallic wires. The whole structure is on ground potential or, respectively, is grounded.

Figure 6:
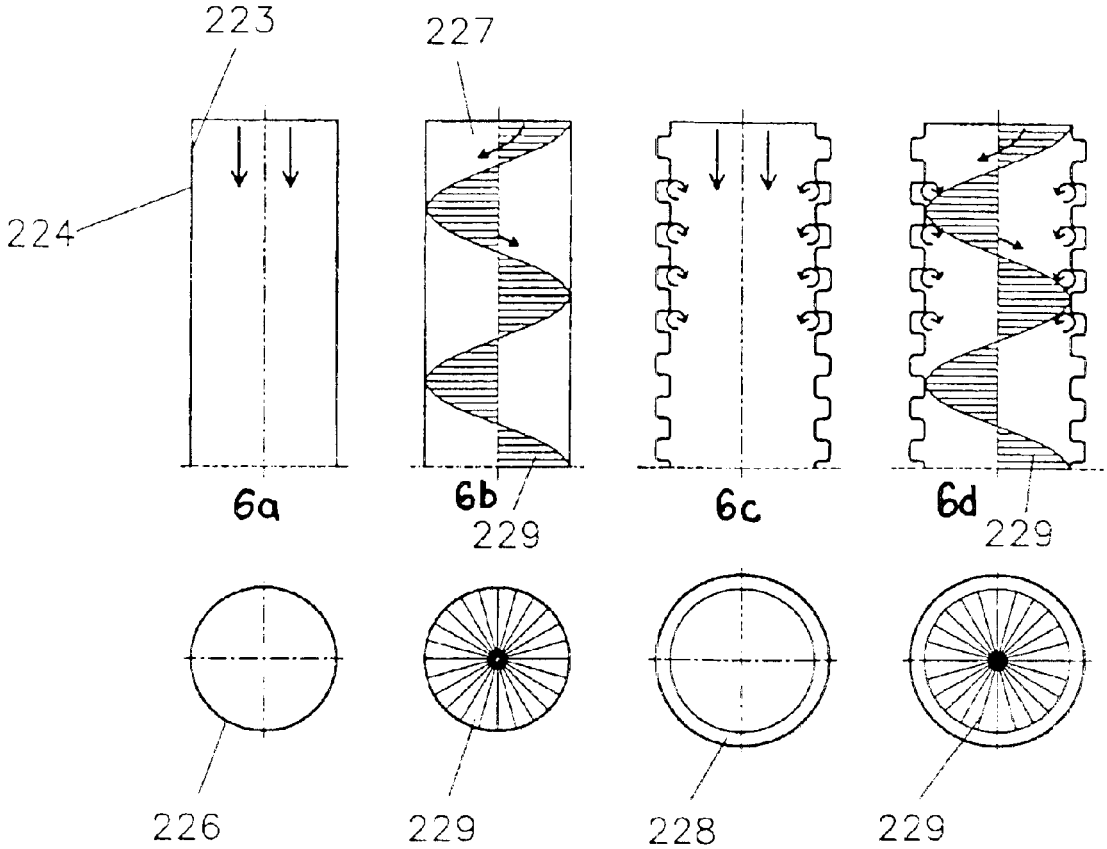
FIGS. 6*a*–6*e* show various types of grounded electrodes.
Figure 6:
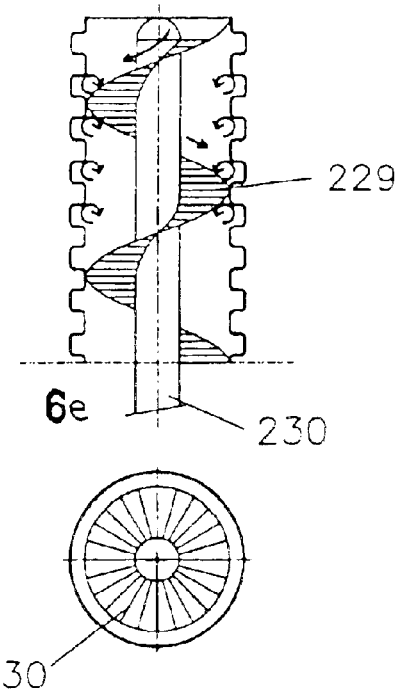
Figure 7:
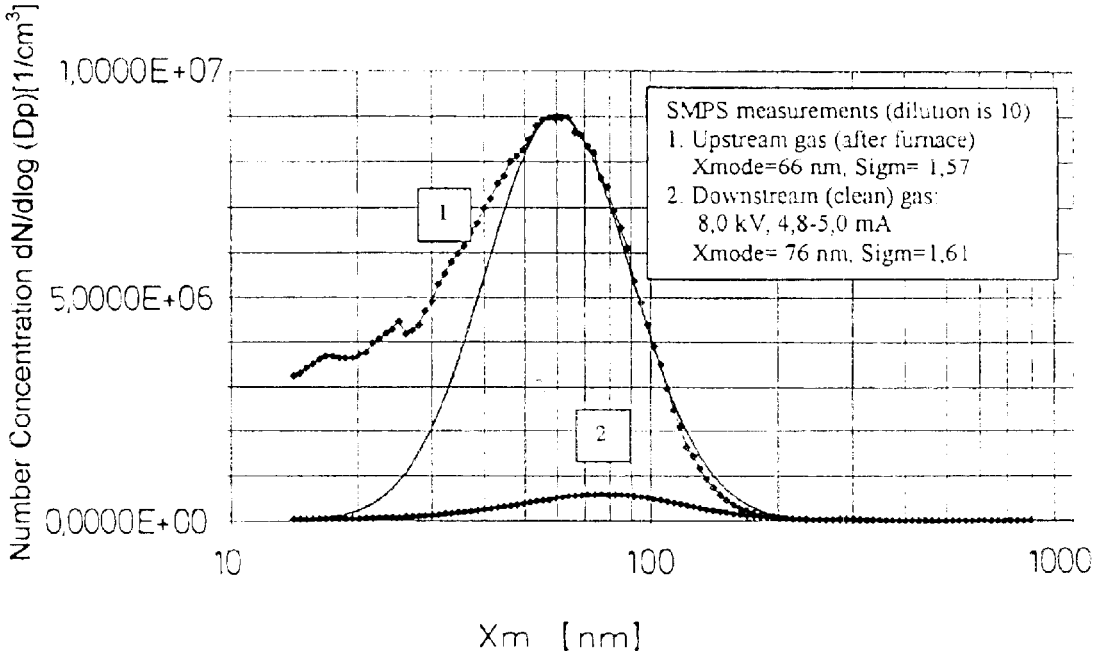
FIG. 7 is a graph showing the experimentally determined concentration distribution of the particles at the inlet and the outlet of the apparatus.

In order to increase the effectiveness of the discharge of the charged particles within the conduit section 2, the gas flow through the tubes is rotated. To this end, each tube includes a spiral 229, which guides the gas in a swirling flow through the tubes. (see FIG. 6). The spirals 229 are axially supported by a center rod 230.

The spray head 220 is installed within the gas conduit in the area between the conduit section 1 and the conduit section 2 above the grounded electrodes 212. The spray head 220 is so arranged that the water spray cone covers fully the upstream front end of the tube bundle 212 or the perforated plate 213 engaging the tubes. The periodical spraying with water reduces the gas temperature provides for a certain moisture content and cleans the inner surfaces of the grounded tubes 212 and, in this way, improves the collection of the charged aerosol particles. The spray water 218 is supplied to the spray head 220 by way of a supply line connected to the connector 219.

Of course, also continuous spraying is possible.

The arrangement 1 shown in FIGS. 5*a*, 5*b*, on the left side shows a final gas purification arrangement without cooling of the tube bundle because there are no flow chambers for a coolant as they are provided in the arrangement 2 on the right (FIGS. 5*c*, 5*d*). In this case, however, the tubes are exposed at both sides, that is the inside and the outside walls, to the gas flow from the space charge area for final cleaning. The remaining charged particles are essentially all deposited and electrically neutralized. In the arrangement 1, the tubes 212 can be in contact with one another. In the arrangement 2, the tubes are held in spaced relationship for the formation of the flow chambers through which the coolant flows around all the tubes, although the spacing may be very small.

Further downstream in the conduit section 3, the filter arrangement is installed. The actual filter material consists of a porous material, which is wrapped around a tubular electrically conductive hollow-cylindrical filter grid cage 323. The outer diameter of the filter cage 323 is smaller than the inner diameter of the conduit section 3 so that an annular gap is formed around the filter. At the upstream front end of the grid cage 323 including the porous filter material 310, a filter cover 311, which forms an annular tub 324, is fitted onto the cage 323. The filter cover 311 is closed in its center by the lid 312. A water line coming from the connector 321 in the wall of the conduit section 3 extends centrally through the lid 312 and is provided centrally within the cage 323 with spray nozzles 322. Water from the gas flow and from the grid 211 is collected in the annular tub 324 and discharged by way of the connectors 319 arranged uniformly spaced around the circumference of the conduit section 3.

The filter cage 323 including the surrounding filter material 310 is supported on the support ring 315, which is supported on an annular console 314 which is disposed at the-down-stream end of the conduit section 3 and which forms, together with the wall of the conduit section 3, an annular water collecting space. On the basis of this console 314 and by way of webs extending from the lid 312 to three support structures 313 arranged on the walls of the conduit 3 in circumferentially uniformly spaced relationship, the filter arrangement is supported and held in position. With this filter arrangement, the gas is directed in the conduit section 3 to flow through the space around the filter and through the filter wall 310, where the remaining particles are removed, into the interior of the filter and then centrally out of the filter through the annular console 314.

The water discharged from the spray heads 322 is sprayed onto the interior wall of the filter and flushes the particles deposited on the filter out of the filter. They are collected in the annular collecting space as filtrate, which is discharged by way of the filtrate discharge connector 317.

In an electrical circuit representation, the charge current $I_{lode}$ can be divided into the ionization current $I_{erde}$ to the grounded electrode 111 of graphite, the neutralization current $I_{aerosol\ I}$ from the main particle deposition from the charging zone in the conduit section 1, the neutralization current $I_{aerosol\ II}$ from the additional particle deposition in the tube bundle 212 and the neutralization current $I_{aerosol\ III}$ for the final particle deposition in the filter 310/323 (see FIG. 1), that is:

$$I_{load}=I_{load}+I_{aerosol}+I_{aerosol\ I}+I_{aerosol\ II}+I_{aerosol\ III}$$

The electrical contacts in the apparatus must be good in order to maintain an effective purification and a purification free of dangers.

The filter cage 323 may by rectangular cylindrical. Other geometries may also be used as long as the effectiveness is not detrimentally affected.

The arrangement for the electrostatic cleaning of the gas from liquid and/or solid submicron particles can be supplied with waste water which has been collected and again be cleaned in a wastewater reconditioning system using standard procedures and equipment. The wastewater reconditioning system is therefore not shown in FIG. 1.

The gas conduit may be circular or it may have a rectangular cross-section. Another shape may also be used as long as it permits efficient operation of the apparatus.

Experimental tests were performed for example with a gas flow of 320 $m^3$/h from the combustion of wood with a combustion rate of 36 kg/h. The gas flow was cooled and saturated with water vapors before it was introduced at 50° C. into the arrangement for the electrostatic cleaning. The particle mass concentration was 40–60 mg/$m^3$. The diagrams of the particle concentration in the upstream and downstream gas flow shows that the use of the apparatus and the method for the purification of gas achieves a substantial reduction of the submicron particle concentration in the gas stream of 95–99%. This result is achieved with a low energy consumption for charging the particles of about 30–50 W and a minimal pressure loss <300 Pa and a corresponding isolation air blower energy consumption of 15 W. The polarity of the voltage applied was negative. The outer dimensions of the apparatus are: height 1200 mm, inner diameter 360 mm. During the test no additional water was sprayed into the gas stream. Self cleaning of the grounded elements of the arrangement did take place.

What is claimed is:

1. An apparatus for the electrostatic purification of a gas flow, comprising, arranged successively in the flow direction of the gas in a conduit, the sections:

A) in a first conduit section (1) an electrostatic charging unit for generating a corona discharge through which the raw gas (4)—electrically charged—passes and forms a space charge volume for a main purification step, B) a unit comprising a group of grounded electrodes arranged in a second conduit section (2) for a follow-up purification, and C) a filter structure arranged in a following third conduit section (3) for filtering the gas flow for final purification, wherein in the electrostatic charging unit installed in the first conduit section (1) in the flow direction of the gas:

an annular collector is disposed at the inner wall surface of the gas conduit for collecting the condensed water from the upstream wall of the gas flow conduit, a grounded electrode (111) is supported in said first conduit section and includes openings or nozzles (120) which have a conically contracting entrance area, a circular center section and a conically expanding exit flow area (121), a grid structure (112) is supported by at least three penetrations (114) evenly distributed over the circumference of the first conduit section so as to extend parallel to the grounded electrode (111), said grid structure (112) being chargeable with a high voltage and having intersecting locations coinciding axially with the openings or nozzles (120) in said grounded electrode (111), pointed electrodes (113) are mounted on the intersection locations so as to be longitudinally adjustable and extend into the conically expanding exit areas (121) of said grounded electrode (111), said space charge volume is provided at the downstream end of said first conduit section (1) and has a metallic wall surface for forming a space charge for the deposition of particles on the metallic wall surface, the group of grounded electrodes (212) installed in the second conduit section (2) consists of a bundle of spaced tubes (212) extending parallel to the axis of the second conduit section (2), perforated end face plates (213) with openings corresponding to the tube bundle (212) are disposed at the upstream and the downstream end feces of the tube bundle such that an admission opening and en exit opening of the inner tube diameter is provided for each of the tubes (212), at least one perforated support plate (222) with openings through which the tubes (212) extend is supported equally spaced between the end face plates 213 so that at least two chambers are formed which are in communication with each other, in the wall of said second conduit section (2) connectors (215, 217) are provided forming inlets and outlets for a coolant (214, 216) for cooling the tubes (212), a grounded support structure with a support grid is supported on a console (210) mounted to the wall of said second conduit section (2), and supports said tube bundle (212), connectors (232) are mounted to said second housing section (2) adjacent said grounded support structure for the discharge of water collected therein, the upstream ends of the grounded electrodes (212) are disposed at a distance from the charging Unit which is 1 to 5 times the diameter D of the grounded electrode (111), upstream from the tube bundle (212) a water supply pipe extends to the center of the second conduit section (2) and is provided with a spray head (220) arranged so as to direct a spray cone over the bundle of grounded electrodes (212) fully covering the front end of the tube bundle (212) to flush off particles deposited thereon, the filter unit disposed in the third conduit section (3) for final filtering the gas is constructed as follows:

a filter structure comprising a tubular support cage (323) enveloped by a porous filter material is supported in the third conduit section (3) in spaced relationship from the wall of the third conduit section (3) to form a gap between the inside wall of the third conduit section and the filter unit into which the gas from the second conduit section (2) is conducted and from which the gas flows through the porous filter material wherein the remaining particles are deposited, the filter unit is supported at its downstream end by an annular console (314) which is connected to the wall of said third conduit section (3) and which, at the same time, forms an annular water collection space, a filter lid (311, 312) is disposed on top of the filter unit and is provided at its top with an annular tub, which is open in an upstream direction for the collection of water, a water supply pipe extends through said filter lid (311, 312) into said filter cage and is provided therein with at least one spray head (322) for spraying water onto the inside wall of said filter for washing said filter, the filter unit (310, 323) including said lid is engaged between consoles (313, 314) mounted to the third conduit section (3) at the upstream and downstream ends of said filter unit.

2. An apparatus according to claim 1, wherein the high voltage grid (112) is supported by said penetrations (114) such that it is adjustable laterally and vertically and said penetrations (114) are provided with a gas connector (117) for supplying a protective gas thereto to ensure insulation.

3. An apparatus according to claim 2, wherein said tubes (212) consist of a metallic or non-metallic material and the surfaces of the electrode-forming tube bundle (212) are increased at least at one side thereof.

4. An apparatus according to claim 3, wherein said tubes (212) are corrugated.

5. An apparatus according to claim 3, wherein said tubes have annular ribs mounted on the tubes in good heat transfer relationship therewith.

6. An apparatus according to claim 1, wherein said tubes include spiral gas conductors for conducting the gas in a spiral, motion through the tubes.

7. An apparatus for the electrostatic purification of a gas flow, comprising, arranged successively in the flow direction of the gas in a conduit comprising three sections:

A) in a first conduit section (1) an electrostatic charging unit for generating a corona discharge through which the raw gas (4) electrically charged—passes and forms a space charge volume for a main purification step, B) a unit comprising a group of grounded electrodes arranged in a second conduit section (2) for a follow-up purification and C) a filter structure arranged in a following third conduit section (3) for filtering the gas flow for final purification, wherein in the electrostatic charging unit installed in the first conduit section (1) in the flow direction of the gas:

an annular collector is disposed at the inner wall surface of the gas conduit for collecting the condensed water from the upstream wall of the gas flow conduit, a grounded electrode (111) is supported in said first conduit section and includes openings or nozzles (120) which have a conically contracting entrance area, a circular center section and a conically expanding exit flow area (121), a grid structure (112) is supported by at least three penetrations (114) evenly distributed over the circumference of the first conduit section so as to extend parallel to the grounded electrode (111), said grid structure (112) being chargeable with a high voltage and having intersecting locations coinciding axially with the openings or nozzles (120) in said grounded electrode (111), pointed electrodes (113) are mounted on the intersection locations 50 as to be longitudinally adjustable and extend into the conically expanding exit areas 121 of said grounded electrode (111), said space charge volume is provided at the downstream end of said first conduit section (1) and has a metallic wall surface for forming a space charge for the deposition of particles on the metallic wall surface, the group of grounded electrodes (212) installed in the second conduit section (2) consists of a bundle of spaced tubes (212) extending parallel to the axis of the second conduit section (2), perforated end face plates (213) with openings are disposed at the upstream and the downstream end faces of the tube bundle, a grounded support structure with a permeable support grid is supported on a console (210) mounted to the wall of said second conduit section (2), and supports said tube bundle (212), connectors (232) are mounted to said second housing section (2) adjacent said grounded support structure, for the discharge of water collected therein, the upstream ends of the grounded bundle of tubes (212) are disposed at a distance from the charging unit which is 1 to 5 times the diameter D of the grounded electrode (111), upstream from the tube bundle (212) a water supply pipe extends to the center of the second conduit section (2) and is provided with a spray head (220) arranged so as to direct a spray cone over the bundle of tubes (212) fully covering the front end of the tube bundle (212) to flush off particles deposited thereon, at least one water discharge connector (232) is provided for discharging water from said tubes (212), the wall thickness of the tubes (212) is, because of an equalized inside and outside pressure, that is, based on the tube diameter D2 in the range of $$0.01\ D_2 < d_{ws} < 0.1\ D_2$$

the filter Unit disposed in the third conduit section (3) for final filtering the gas is constructed as follows:

a filter structure comprising a tubular support cage (323) enveloped by a porous filter material is supported in the third conduit section (3) in spaced relationship from the wall of the third conduit section (3) to form a gap between the inside wall of the third conduit section and the filter unit into which the gas from the second Conduit section (2) is conducted and from which the gas flows through the porous filter material wherein the remaining particles are deposited, the filter unit, is supported at its downstream end by an annular console (314) which is connected to the wall of said third conduit section (3) and which, at the same time, forms an annular water collection space, a filter lid (311, 312) is disposed on top of the filter unit and is provided at its top with an annular tub, which is open in an upstream direction for the collection of water, a water supply pipe extends through said filter lid (311, 312) into said filter cage and is provided therein with at least one spray head (322) for spraying water onto the inside wall of said filter for washing said filter, the filter unit (310, 323) including said lid is engaged between consoles (313, 314) mounted to the third conduit section (3) at the upstream and downstream ends of said filter unit.

8. An apparatus according to claim 7, wherein the high voltage grid (112) is supported by said penetrations (114) such that it is adjustable laterally and vertically and said penetrations (114) are provided with a gas connector (117) for supplying a protective gas thereto to ensure insulation.

9. An apparatus according to claim 7, wherein said tubes include spiral gas conductors for conducting the gas in a spiral motion through the tubes.

10. A method for the electrostatic purification of a gas stream in a gas purification plant, wherein said gas stream is first cooled and water-vapor saturated, the gas stream is then conducted past a condensate collector (110) through a grounded nozzle plate (111) having conical nozzle exit a teas into an electrode space formed by the nozzle exit areas and high voltage electrode tips (122) extending into said exit areas, where the gas is expanded and wherein aerosol particles carried in the gas stream are electrostatically charged by a corona discharge, the gas stream is then supplied to a space defined by grounded walls (2) on which some of the charged particles are deposited and then through the interior of a bundle of grounded tubes (212) on the walls of which additional charged particles are deposited, which cooling water is conducted around the outer wall surfaces of said grounded tubes to remove heat therefrom, the gas stream is then conducted radially inwardly through an annular filter of a porous material (310) whereby the last remaining gas particles are deposited which water is periodically or continuously sprayed onto the inner surfaces of the annular filter for flushing the deposits of said filter and the water is collected and finally conducting the purified and electrically neutralized gas out of the filter through its central bottom opening into the environment.

11. A method according to claim 10, wherein the grounded tubes through which said gas stream is conducted is periodically flushed by a water spray.

12. A method according to claim 11, wherein the gas stream is cooled while passing through the grounded tubes by coolant conducted past the outside surface of said tubes, whereby particle deposition on the inside walls of said tubes is enhanced.

13. A method according to claim 12, wherein the gas Stream is conducted through said tubes in a swirling fashion by a spiral insert in said tubes so that the particles are subjected to centrifugal forces forcing them toward the wails of the grounded tubes where they are deposited.

14. A method according to claim 13, wherein the heat of the coolant heated during passage past said tubes is used for heating an insulating gas or, if said coolant is a gas, is directly used as insulating gas.

15. A method for the electrostatic cleaning of gas according to claim 10, wherein said gas is conducted over both the inner and outer surfaces of said grounded tubes whereby said charged particles are deposited on both surfaces of said tubes and both surfaces of said grounded tubes are periodically flushed.

* * * * *